US006610643B1

(12) United States Patent
Von Bezold

(10) Patent No.: US 6,610,643 B1
(45) Date of Patent: Aug. 26, 2003

(54) DETERGENT TABLET PACKAGING FOR DISHWASHERS

(75) Inventor: Goetz-Dietrich Von Bezold, Gauting (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/806,434

(22) PCT Filed: Oct. 5, 1999

(86) PCT No.: PCT/EP99/07374

§ 371 (c)(1),
(2), (4) Date: Jul. 3, 2001

(87) PCT Pub. No.: WO00/20298

PCT Pub. Date: Apr. 13, 2000

(30) Foreign Application Priority Data

Oct. 5, 1998 (DE) ..... 198 45 602

(51) Int. Cl.[7] ..... C11D 17/04
(52) U.S. Cl. ..... 510/439; 510/224; 510/446
(58) Field of Search ..... 510/439, 224, 510/446

(56) References Cited

U.S. PATENT DOCUMENTS 4,551,263 A 11/1985 Shellhammer et al. . 252/186.39
5,382,377 A * 1/1995 Raehse et al. ..... 510/451
5,783,541 A * 7/1998 Tack et al. ..... 510/224
5,900,399 A 5/1999 Wolfgang et al. ..... 510/446
6,329,335 B1 * 12/2001 Feist et al. ..... 510/446

FOREIGN PATENT DOCUMENTS

| | | | |
|---|---|---|---|
| CH | 511 157 | | 8/1971 |
| DE | 295 09 593 | | 9/1995 |
| DE | 195 00936 | A1 | 7/1996 |
| EP | 0 318 204 | A1 | 5/1989 |
| EP | 0 391 087 | | 10/1990 |
| EP | 0 593 952 | A1 | 4/1994 |
| EP | 0899208 | A1 * | 3/1999 |
| EP | 0903405 | A2 * | 3/1999 |
| JP | 09240683 | | 9/1997 |
| WO | WO 92/20774 | A1 * | 11/1992 |
| WO | WO 92/20775 | | 11/1992 |

* cited by examiner

*Primary Examiner*—Lorna M. Douyon
(74) *Attorney, Agent, or Firm*—Stephen D. Harper; Glenn E. J. Murphy

(57) ABSTRACT

A machine dishwashing detergent tab pack comprising a tablet form detergent composition surrounded by a wrapper, the detergent composition in the form of at least two seperate tablet form portions or in a single tablet form divided into portions, wherein at least two of the separate portions contained in the wrapper differ in composition.

4 Claims, 1 Drawing Sheet

DETERGENT TABLET PACKAGING FOR DISHWASHERS

CROSS-REFERENCE TO RELATED APPLICATIONS

This application is a U.S. National Stage application filed under 35 U.S.C. §371, claiming priority of International Application No. PCT/EP99/07374, filed Oct. 5, 1999 in the European Patent Office, and DE 198 45 602.6, filed Oct. 5, 1998 in the German Patent Office, under 35 U.S.C. §§119 and 365.

BACKGROUND OF THE INVENTION

The present invention relates to a detergent tab pack comprising a compact detergent composition processed in the manner of a tablet, surrounded by a wrapper.

Detergents for machine dishwashers are commercialized in powder form and in the form of tablets, known as tabs. Tabs have the advantage that there is no need to measure out the amount of detergent. A problem, however, is the addition of detergent in the prewash. Some manufacturers prescribe placing the tabs in the dispenser compartment, but in that case no detergent is available for the prewash. There are also tabs which are intended for insertion into the cutlery basket. In this case, however, it is very difficult to configure the dissolution characteristics of the detergent composition in such a way that the correct amounts dissolve in each case during the prewash and during the main wash, since the duration and temperature of the prewash may differ considerably among the various types of dishwasher and between different programs.

DESCRIPTION OF THE INVENTION

By means of the present invention this problem is solved by virtue of the detergent composition which is contained in a wrapper and comprises at least two portions which are separate or which can be separated at a predetermined point. The portions preferably have different sizes, i.e., the detergent composition is asymmetrically divided. In one preferred embodiment, it comprises a first, relatively small portion for the prewash and a second, larger portion for the main wash.

More than two portions in a wrapper may be rational if, in the case of a low ware load, prewashing is carried out a number of times and a number of prewash detergent portions are required. Multiple subdivision of the tabs also permits more precise measuring of the amount of detergent.

The portions of the detergent composition may be contiguous and separable by means of a breaking groove. The wrapper may also contain mechanically separated detergent elements. In this case, the wrapper may have separate compartments for the different portions.

The detergent composition may comprise the customary detergent formulations. Its portions may differ with regard to their ingredients, in order to achieve an optimum wash in each case, and/or may differ in color, i.e., with regard to the amount of colorant, such as dye or pigment, it comprises.

DESCRIPTION OF THE DRAWINGS

The invention is illustrated below using exemplary embodiments and with reference to the drawing.

Figure 1:
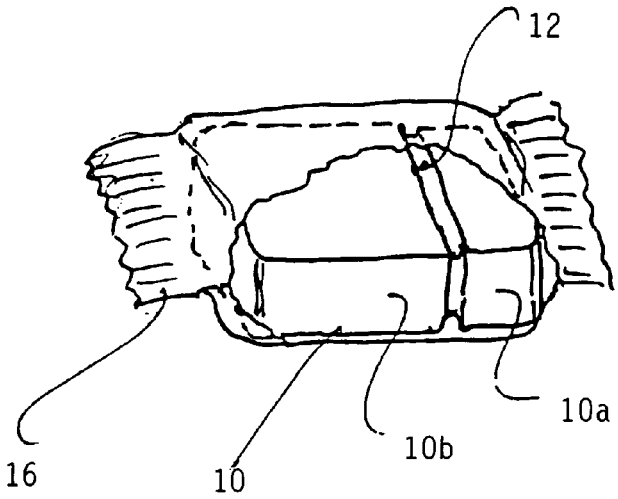
FIG. 1 shows a first embodiment of the detergent tab pack of the invention, in which the detergent composition forms a single element which can be parted by means of a breaking groove.

The detergent tab pack depicted in FIG. 1 comprises a single, substantially right-parallelepipedal detergent element 10 which is divided by a breaking groove 12 extending parallel to the smallest side face into two portions and can be parted accordingly, namely a relatively small first portion 10*a* for the prewash and a larger second portion 10*b* for the main wash. In the customary manner, the detergent element 10 is surrounded by a continuous, polymer film wrapper 16 which can be opened by tearing.

Figure 2:
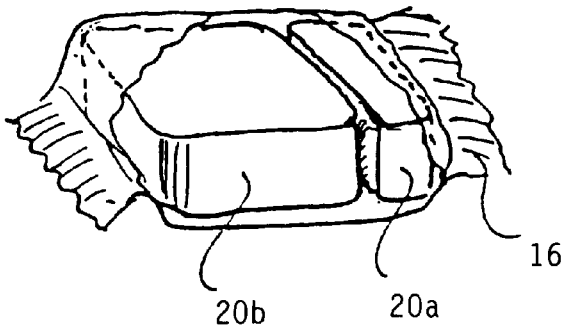
FIG. 2 shows a second embodiment, in which the detergent composition has two separate portions.

In the case of the detergent tab pack of FIG. 2, the wrapper 16 contains two mechanically separated, different-sized portions 20*a* and 20*b* which are accommodated together inside the wrapper.

Figure 3:
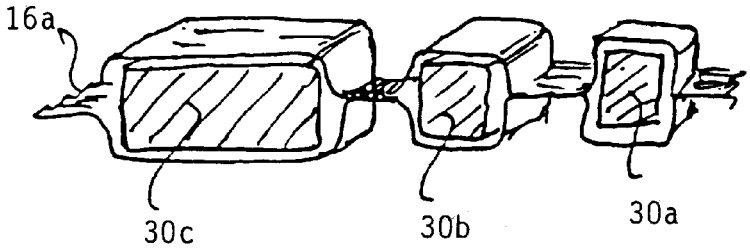
FIG. 3 shows an embodiment with three separate detergent elements, accomodated in separate compartments of a coherent wrapper.

In the case of the embodiment of FIG. 3, two relatively small portions 30*a* and 30*b* of the detergent composition are accommodated in a first chamber and a second chamber of the wrapper 16*a*. A third, larger portion 30*c* is accommodated in a third chamber of the wrapper that is connected to the first two chambers. This embodiment is particularly suitable for the case where more than two tab portions are envisaged.

Figure 4:
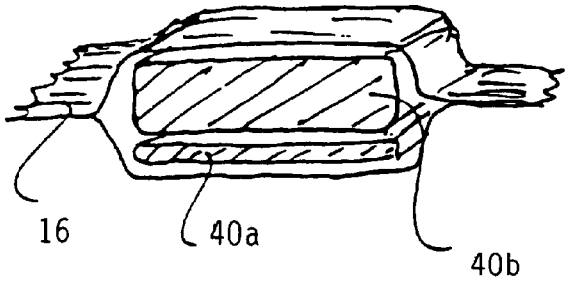
FIG. 4 shows a modification of the exemplary embodiment according to FIG. 2.

Like that of FIG. 2, the embodiment of FIG. 4 contains two separate detergent element portions 40*a* and 40*b* for the prewash and main wash, respectively, separation in this case taking place parallel to the large face of the right-parallelepipedal elements.

If the pack contains two or more relatively small tab portions, it is judicious if the ratio of the amount of detergent in the relatively small tab portions to the amount needed for the main wash is a small integral ratio, e.g., 1:2 or 1:3. In that case, a corresponding number of extra relatively small portions may be used for the main wash. It is also possible in one wrapper to accommodate two or more relatively small portions, in which the amount of detergent individually is sufficient for a prewash but not for a main wash, but in its entirety is enough for a main wash and, if appropriate, a prewash.

The portion envisaged for the prewash may comprise more surfactant than the portion envisaged for the main wash, in order to promote the removal of indissoluble food residues, e.g., spinach, while the portion intended for the main wash additionally comprises, for example, enzymes, etc., which develop their activity to particulary good effect during the main wash, which lasts longer and operates at higher temperatures.

In the case of one exemplary embodiment of the present detergent tab packs, the smaller portions are free from dye and pigment while the larger portions comprise a blue dye.

The ratio of the weights of prewash portion to main wash portion in one preferred exemplary embodiment of a pack containing two tab portions is from 1:4 to 1:6. This ratio, especially in the case where the two portions differ in composition, may also be situated between 1:2 and 1:10. These values and ranges should not be interpreted restrictively.

The detergent element 10 in FIG. 1 may have more than one breaking groove. The larger portions 20*b* (FIG. 2), 30*c* (FIG. 3), and the portions 40*a* and 40*b* (FIG. 4) may also be provided with at least one breaking groove which allows the elements in question, for example, to be halved. The elements 10, 20*a,* 20*b,* 30*a,* 30*b* and 30*c* may be subdivided as in FIG. 4.

What is claimed is:

1. A machine dishwashing detergent tab pack comprising a single tablet form detergent composition surrounded by a wrapper, the single tablet form comprising at least two portions, said portions are contiguous and separable from one another by one or more breaking grooves, wherein at least two portions of the single tablet form differ in composition.

2. The machine dishwashing detergent tab pack of claim 1, wherein at least two of the portions of the single tablet form differ in size.

3. The machine dishwashing detergent tab pack of claim 2, wherein the single tablet form detergent composition comprises at least one relatively small portion dimensioned for a prewash cycle and at least one relatively large portion dimensioned for a main wash cycle.

4. The machine dishwashing detergent tab pack of claim 2, wherein the at least two portions of the single tablet form differing in size also differ in color.

* * * * *